US006161256A

United States Patent [19]

Quiring et al.

[11] Patent Number: 6,161,256

[45] Date of Patent: Dec. 19, 2000

[54] DRILL HANDLE COVER

[76] Inventors: Herbert J. Quiring, 719 Brooks La., Sedalia, Colo. 80135; Jeffrey A. Laurell, Box 6249, Woodland Park, Colo. 80866

[21] Appl. No.: 09/432,232

[22] Filed: Nov. 3, 1999

[51] Int. Cl.[7] ..... A45C 13/22; A45C 13/26; E05B 1/00

[52] U.S. Cl. ..... 16/431; 16/435; 16/421; 81/436; 81/489; 81/177.1; 173/162.1; D8/68

[58] Field of Search ..... 16/431, 430, 435, 16/422, 421, DIG. 12; 81/436, 489, 177.1; 173/169, 170, 162.1, 162.2; D8/303, 313, 61, 68, 80, 107, DIG. 1, DIG. 7

[56] References Cited

U.S. PATENT DOCUMENTS

| | | | |
|---|---|---|---|
| D. 341,761 | 11/1993 | Weimann | D8/68 |
| D. 395,387 | 6/1998 | Snider | D8/68 |
| 2,425,245 | 8/1947 | Johnson | 16/431 |
| 2,914,785 | 12/1959 | Ela | 16/430 |
| 3,269,399 | 8/1966 | Smith | 16/431 |
| 4,711,308 | 12/1987 | Blaas et al. | 173/162.1 |
| 5,347,684 | 9/1994 | Jackson | 16/431 |
| 5,353,474 | 10/1994 | Good et al. | 16/431 |
| 5,475,896 | 12/1995 | Wang | 16/431 |
| 5,813,477 | 9/1998 | Clay et al. | 173/162.1 |
| 6,026,910 | 2/2000 | Masterson et al. | 173/162.2 |

*Primary Examiner*—Chuck Y. Mah
*Attorney, Agent, or Firm*—G. F. Gallinger

[57] ABSTRACT

A handle cover which facilitates holding a drill is disclosed. The cover has an upper cover portion surrounding the rear and side portions of the barrel portion of the drill; and, a lower cover portion surrounding the rear and side portions of the handle portion of the drill. The cover has two pads, one adjacent to a rear portion of the handle, and the other adjacent to a rear portion of the barrel, so that the hand is cushioned when it holds the drill either by its handle or barrel portion.

9 Claims, 1 Drawing Sheet

DRILL HANDLE COVER

FIELD OF INVENTION

Figure 1:
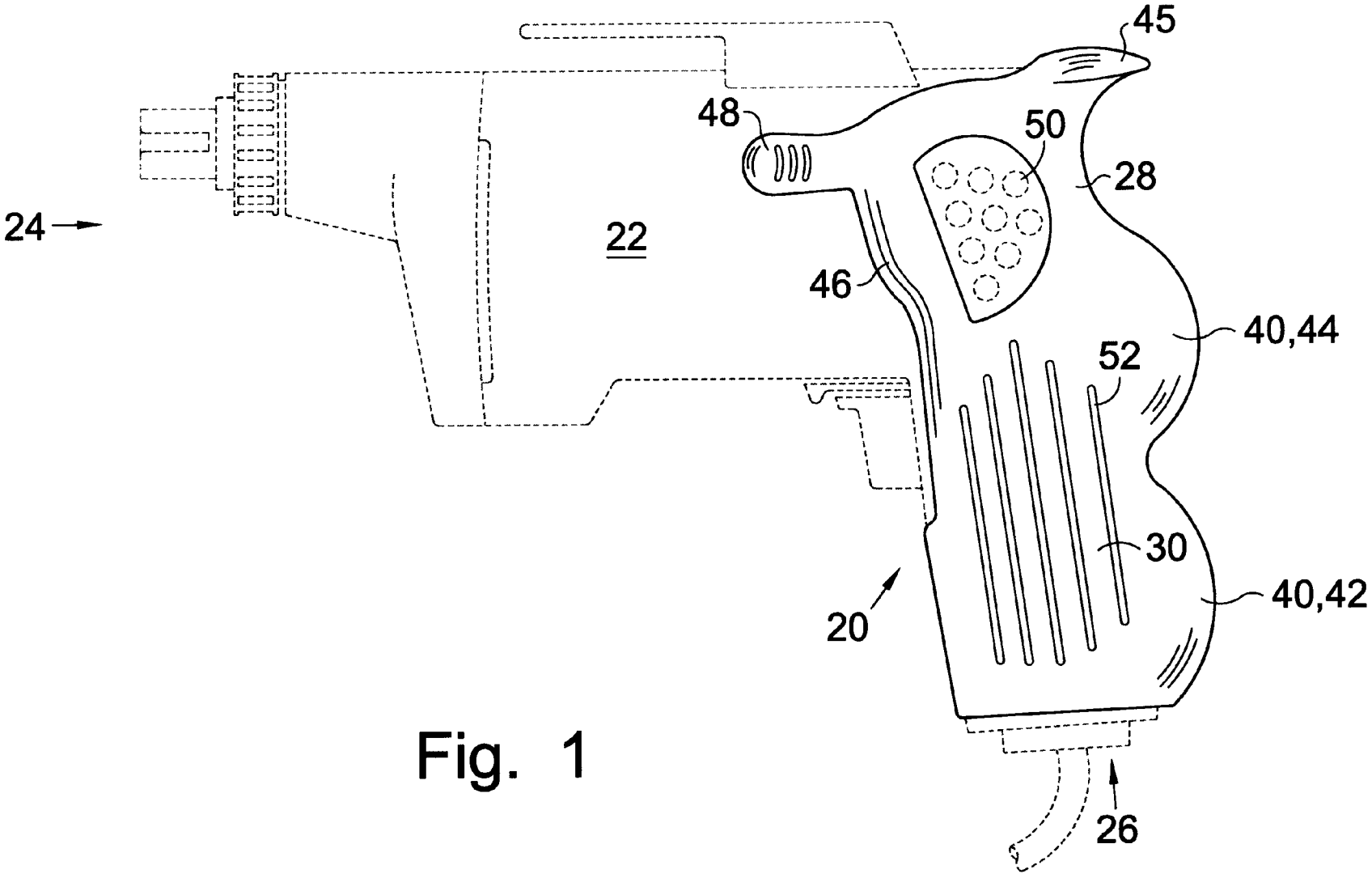

This invention relates to the ergonomics of drills, drill drivers, and screw guns. More particularly this invention relates to a drill handle cover which facilitates holding a drill.

BACKGROUND OF THE INVENTION

The applicant is involved in residential construction and the hanging of sheetrock with a screw gun. Like others he has worked with, he has found that holding a screw gun by its lower handle portion for extended periods is tiring for both his hands and his wrists. To alleviate the strain on a few over worked muscles he has held the screw gun in different positions in his hand. One position wherein the drill is held in longitudinal alignment with the arm alleviates wrist strain. With contoured cushions these alternative positions become much more viable. A cushion not only absorbs shock and vibration; but additionally, reshapes the drill handle to better fit a user's hand.

One problem with a cushioned handle is that it is not nearly as durable as the molded hard plastic handle of the drill.

OBJECTS AND STATEMENT OF INVENTION

It is an object of this invention to disclose a handle cover for a drill which will facilitate holding the drill in alternate positions. It is yet a further object of this invention to disclose a handle cover which is cushioned—one which will be softer against the hand, and one which will be better able to conform to the varying sizes and shapes of user's hands. It is yet a further object of this invention to disclose a handle cover for a drill which may be removably attached to a drill so that it may be subsequently replaced after an interval of use.

Throughout this application drill is used in its broader sense and is defined to additionally include screw guns and drill drivers.

One aspect of this invention provides for a handle cover for facilitating holding a drill having a lateral barrel portion having a top, front, rear, and lateral side portions, and a handle portion having a rear and lateral side portions, said handle portion extending downwardly beneath the barrel portion, comprising: an upper cover portion surrounding the rear and side portions of the barrel portion; and, a lower cover portion surrounding the rear and side portions of the handle portion of the drill.

There are two pads. Each cover portion has a pad, one adjacent to a rear portion of the handle, and the other adjacent to a rear portion of the barrel, so that the hand is cushioned when it holds the drill by either the handle or barrel portion.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein:

FIG. 1 is a perspective view of a drill having a handle cover mounted thereon.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a drill having a handle cover mounted thereon. The handle cover 20 which facilitates holding a drill 22 having a lateral barrel portion 24 and a handle portion 26 extending downwardly beneath the barrel portion 24, comprises an upper cover portion 28 surrounding the rear and side portions of the barrel portion 24 and, a lower cover portion 30 surrounding the rear and side portions of the handle portion 26.

The cover 20 has an enlarged pad 40 on a rear portion thereof to cushion the palm of a hand holding the drill 22. In the most prefered embodiment of the invention there are two pads 40, one 42 adjacent to a rear portion of the handle portion 26, and the other adjacent to a rear portion of the barrel portion 24, so that a hand is cushioned when it holds the drill 22 either by its handle portion 26 or barrel portion 24.

The preferred embodiment of the handle cover 20 additionally has an upper lip 45 extending rearwardly from a top portion of the barrel portion 24 to prevent the drill 22 from slipping downwardly through a hand holding it. A central lip 46 on a front side portion of the cover 20 allows a user to wrap their finger therearound. An index finger tab 48 on a side portion of the barrel portion 24 of the cover 20 enables an index finger to rest and grip thereon.

The pads 40 are more shock absorbant than the handle cover 20. The handle cover 20 is made of soft plastic. The plastic may have a void within the pad 40; or alternatively, the pad 40 may be cushioned by foam therein.

To facilitate air cooling of the drill 22 the cover has an opening 50 therein. The cover 20 itself also insulates one's hand from the heat of the drill 22. Upright sweat grooves 52 on the handle portion 26 of the cover 20 facilitate holding. The cover 20 is removably attachaed to the drill 20. The handle portion of the cover 20 may be stretched to pull it over and around the handle portion 26 of the drill 22. The barrel portion of the cover 20 may be removably secured to the drill 20 with adhesive.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

We claim:

1. A handle cover for facilitating holding a drill having a lateral barrel portion having a top, front, rear, and lateral side portions, and a handle portion having a rear and lateral side portions, said handle portion extending downwardly beneath the barrel portion, comprising:

an upper cover portion adapted to surround the rear and side portions of the barrel portion;

a lower cover portion adapted to surround the rear and side portions of the handle portion;

said cover portions each having a pad, one adjacent to the rear portion of the barrel portion, and the other adjacent to the rear portion of the handle portion, so that a hand is cushioned when it holds the drill by one of the handle and barrel portions thereof.

2. A cover as in claim 1 further comprising an upper lip extending rearwardly from a top portion of the barrel portion of the cover to prevent the drill from slipping downwardly through a hand.

3. A cover as in claim 2 further comprises a central lip on a front side portion of the cover to allow a user to wrap a finger therearound.

4. A cover as in claim 3 further comprising an index finger tab on a side portion of the barrel portion of the cover so that an index finger can rest and grip thereon.

5. A cover as in claim 2 wherein the pads are more shock absorbant than the handle cover generally.

6. A cover as in claim 5 wherein the handle cover is made of soft plastic and the plastic has a void within the pad.

7. A cover as in claim 2 wherein the cover has an opening to facilitate the air cooling of the drill.

8. A cover as in claim 2 wherein the cover has upright sweat grooves on its lower cover portion.

9. A cover as in claim 2 wherein the handle portion of the cover may be stretched to pull it over and around the handle portion of the drill.

* * * * *